United States Patent [19]

Heberlein

[11] Patent Number: 4,724,739

[45] Date of Patent: Feb. 16, 1988

[54] ARRANGEMENT FOR THE INFEED AND WITHDRAWAL OF CASELESS AMMUNITION

[75] Inventor: Werner Heberlein, Nuremberg, Fed. Rep. of Germany

[73] Assignee: Diehl GmbH & Co., Nuremberg, Fed. Rep. of Germany

[21] Appl. No.: 925,285

[22] Filed: Oct. 31, 1986

Related U.S. Application Data

[63] Continuation-in-part of Ser. No. 669,617, Nov. 8, 1984, abandoned, which is a continuation-in-part of Ser. No. 402,907, Jul. 29, 1982, abandoned.

[30] Foreign Application Priority Data

Aug. 17, 1981 [DE] Fed. Rep. of Germany ..... 3132318

[51] Int. Cl.[4] ..... F41D 10/02

[52] U.S. Cl. ..... 89/33.2; 89/35.01

[58] Field of Search ..... 89/35.01, 35.02, 33.14, 89/33.16, 33.2, 33.25; 86/48

[56] References Cited

U.S. PATENT DOCUMENTS 3,229,584 1/1966 Zehnder ..... 89/35.01

FOREIGN PATENT DOCUMENTS 2105446 3/1983 United Kingdom ..... 89/35.01

*Primary Examiner*—Herbert B. Guynn
*Assistant Examiner*—John S. Maples
*Attorney, Agent, or Firm*—Scully, Scott, Murphy & Presser

[57] ABSTRACT

An arrangement for the infeed and withdrawal of caseless ammunition from automatic firearms, consisting essentially of a belt feed mechanism and a cartridge belt conveyed thereby, which includes cartridge pockets at regular intervals interconnected with each other. The pockets formed of two arms which are bent about the cartridges transversely of the longitudinal axis of the belt. The opposite free ends of the arcuately-shaped metal arms which are arranged at a spacing from each other include means which are in operative association with spreader elements of the feed mechanism for the spreading apart of the arcuately-shaped metal arms so as to allow for cartridge withdrawal. Through intermediary of the means which are arranged on the arms, and which are in operative association with the respective spreader elements of the star wheel or feed mechanism, there is additionally possible a simple withdrawal of the cartridges within the weapon and completely without any damaging of the ammunition. The spreading apart of the arms affords that the inserted cartridges can be easily slid out of the belt and into the weapon.

8 Claims, 14 Drawing Figures

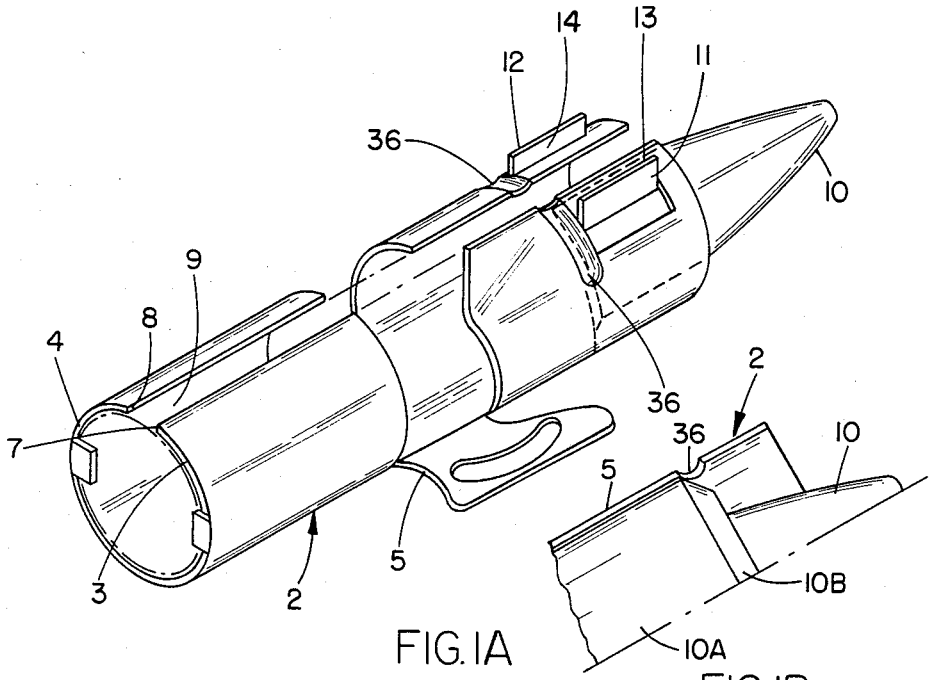
FIG. 1A
FIG. 1B
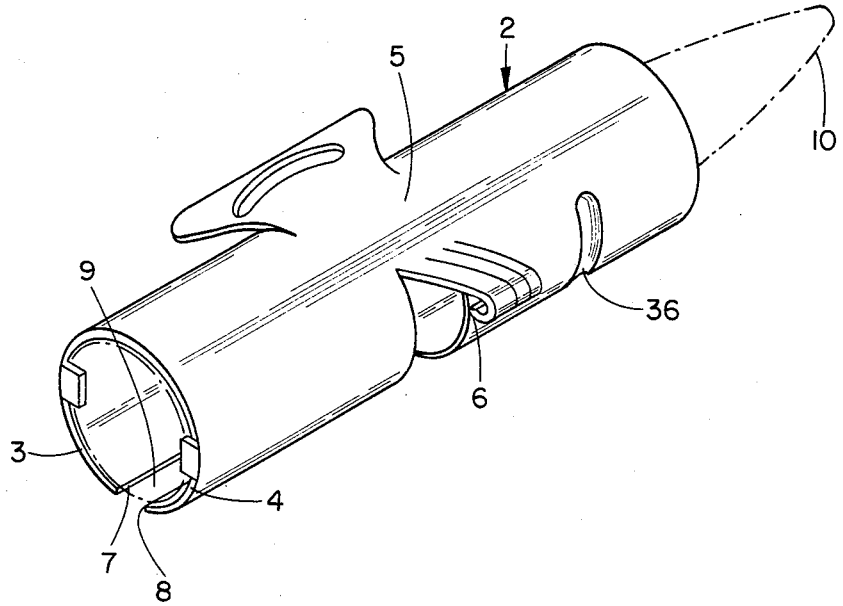
FIG. 2A

ARRANGEMENT FOR THE INFEED AND WITHDRAWAL OF CASELESS AMMUNITION

CROSS-REFERENCE TO RELATED APPLICATIONS

The present application is a continuation-in-part application of U.S. patent application Ser. No. 669,617 filed Nov. 8, 1984, now abandoned, which is a continuation-in-part application of Ser. No. 402,907 filed July 29, 1982, now abandoned.

BACKGROUND OF THE INVENTION

1. Field of the Invention

The present invention relates to an arrangement for the infeed and withdrawal of caseless ammunition from automatic firearms, consisting essentially of a belt feed mechanism and a cartridge belt conveyed thereby, which includes cartridge pockets at regular intervals interconnected with each other, and which are presently formed of two arms which are bent about the cartridges transversely of the longitudinal axis of the belt.

2. Discussion of the Prior Art

A cartridge belt which is associated with an installation of this type is presently known from German Published Patent Application No. 20 12 379, published Sept. 24, 1970. In that instance, the belt consists of a plastic material, for example, polyethylene, in which grooves are formed through heating at regular intervals for receiving the cartridges. Furthermore, hinges in the form of small grooves are impressed into the belt for the attainment of flexibility. After the insertion of the cartridges, a thin film strip is positioned over the belt and fastened through welding so that the cartridges are retained in the inserted position. The withdrawal of the cartridges is effected in the weapon through tearing open of the film strip at the respective locations by means of the load mechanism. When this known cartridge belt has to concurrently solve the problems of achieving of a relatively low weight and a good degree of flexibility, there is then encountered the disadvantage that there is not afforded an adequate protection of the caseless ammunition under the rough-handled troop and weapon operation.

The disclosure of Zehnder U.S. Pat. No. 3,229,584 describes an automatic firearm feed mechanism incorporating an ammunition belt of cartridges connected through the intermediary of links. The links disclosed herein are in the shape of clamping elements intended for use with encased ammunition, and will collapse together upon removal of the cartridges; in effect, provide a stable structure only when the cartridges are inserted therein. The clamping action of the links would damage caseless ammunition, and even lead to destruction of the propellant powder components thereof. In contrast therewith, the inventive cartridge pocket structure forms a transport medium, as well as a protective sleeve for caseless ammunition.

SUMMARY OF THE INVENTION

Accordingly, it is an object of the present invention to provide an arrangement for the infeed and withdrawal of caseless ammunition of the above-mentioned type, in which the caseless ammunition is afforded an optimum degree of protection from damage even under difficult conditions of use and, handling, while nevertheless, being still flexible and simple in its production and its manipulation.

The foregoing object is inventively achieved in that the opposite free ends of the arcuately-shaped metal arms which are arranged at a spacing from each other include means which are in operative association with spreader elements of a feed mechanism for effecting the spreading apart of the arcuately-shaped metal arms so as to allow for withdrawal of the cartridge. Such metal arms which, in accordance with a further feature of the invention, encase each of the cartridges along substantially their entire lengths, afford an optimum degree of protection to be imparted to the propellent charge component of the caseless ammunition, which is especially sensitive to damage. Through the intermediary of the means which are arranged on the arms, and which are in operative association with the respective spreader elements of the star wheel or feed mechanism, in an advantageous manner there is additionally possible a simple withdrawal of the cartridges within the weapon and completely without any damaging of the ammunition. The spreading apart of the arms affords that the inserted cartridges can be easily slid out of the belt and into the weapon. This is effected without adversely influencing the usually necessarily high loading speed and without any damaging of the propellent charge component. A belt which incorporates the inventive arrangement can be continually or repeatedly reused so that there is achieved a significant assist in savings by reducing the requirements for and expenditures of raw material.

BRIEF DESCRIPTION OF THE DRAWINGS

Further inventive features may now be ascertained from the following detailed description of exemplary embodiments of the invention, taken in conjunction with the accompanying drawings; in which:

FIG. 1A illustrates a perspective view of a cartridge element from which the cartridge belt of FIG. 1 is constructed;

FIG. 1B illustrates a fragmentary, sectional view of the cartridge element of FIG. 1A;

FIG. 2A comprises the same isometric view shown in FIG. 1A; however, rotated 180° on its longitudinal axis.

DETAILED DESCRIPTION

Figure 1:
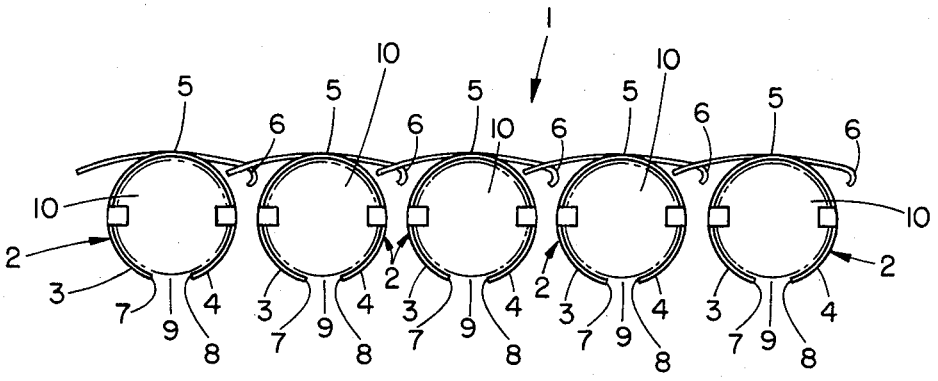
FIG. 1 schematically illustrates a side view of the cartridge belt pursuant to the invention.
Figure 2:
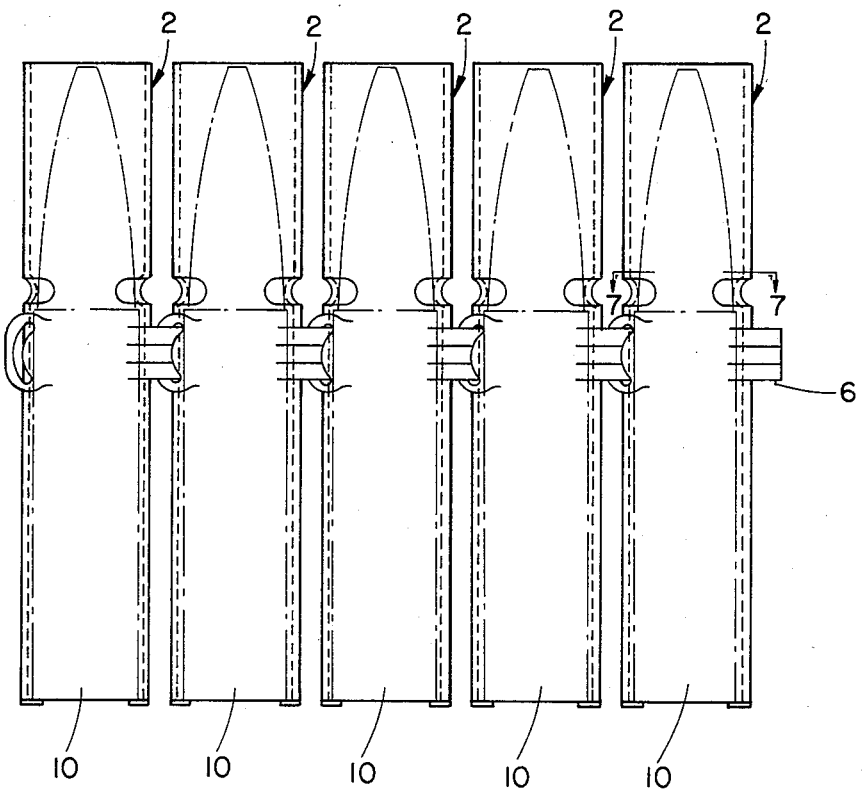
FIG. 2 illustrates a plan view of the cartridge belt of FIG. 1.

The cartridge belt 1 pursuant to FIGS. 1 and 2 consists of a large number of serially-connected cartridge pockets 2 which are arranged at regular intervals, which are all articulatedly connected with each other. The cartridge pockets are presently each formed of two arms 3, 4 which extend unitarily from base elements 5 to which there are attached the connecting joints 6. The free ends 7, 8 of the arcuately-shaped arms 3, 4 are located at a fixed spacing 9 opposite each other. Arranged within the cartridge pockets, which are formed of metal, are the caseless cartridges 10.

Figure 3:
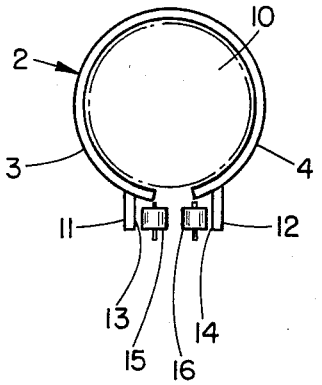
FIG. 3 illustrates a belt portion with inserted cartridge and a first embodiment of the inventive spreader elements.

Fixedly positioned on the arcuately-shaped arms 3, 4, at or proximate their free ends 7, 8, are spreader jaws 11, 12. The spreader jaws 11, 12 pursuant to FIG. 3 are equipped with flat surfaces 13, 14 oriented in parallel with the cartridge axis, and which are arranged at a fixed distance opposite each other.

Engaging between the flat surfaces 13, 14 of the spreader jaws 11, 12 are spreader elements which are formed as roll bodies 15, 16. Hereby, the spacing between the flat surfaces 13, 14 of the spreader jaws is less than the spacing between the outer diameters of the roll bodies so that, upon interposition of the roll bodies between the flat surfaces 13, 14 there is effectuated a spreading apart of the arms 3, 4. Even a relatively small extent of spreading apart is sufficient to allow the cartridge 10 to be pressed easily and without damaging the caseless propellent charge component from the cartridge pocket into the weapon.

As shown in FIG. 1A, the restraints 36 which are impressed into the cartridge pockets 2 are basically annularly extending detents which position themselves against the inclined shoulder 10B of the powder section or member 10A of the cartridge. From this powder member 10A, the projectile body 10 projects axially forwardly. By means of the restraints 36, the cartridge 10 is prevented from sliding forwardly out of the cartridge pocket 2. The tabs 5A which are integrally bent inwardly at the rear end of the basic element 5 of the cartridge pocket 2 prevent any sliding out of the cartridge 10 in a rearward axial direction. As a result of this structure, the cartridge 10 is inserted within the cartridge pocket 2 of the cartridge belt so as to prevent any falling out of the cartridge during the transporting phase of the belt. A radial bending apart of the cartridge pockets 2 is possible by means of the clamping jaws formed by the extensions or protuberances 11, 12, 13 and 14, and a result of which the cartridge 10 can be slid axially forwardly out of the cartridge pocket 2 of the cartridge belt after the restraint 36 has been displaced out of engagement with the inclined shoulder 10B of the powder member 10A on the cartridge 10.

Figure 3A:
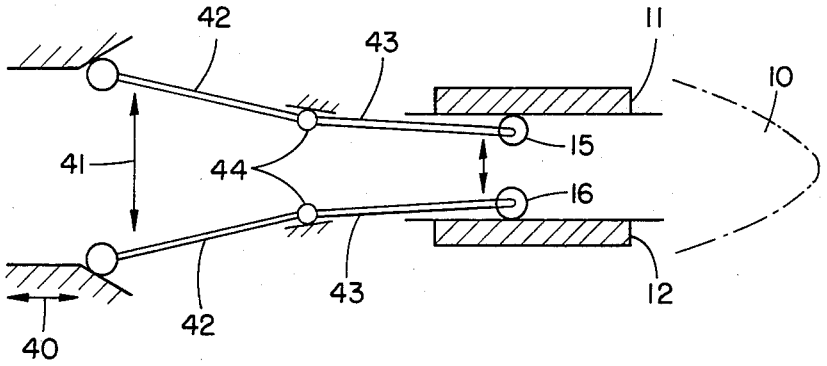
FIG. 3A illustrates, generally diagrammatically, the operative mechanism for the spreader elements of FIG. 3.

Referring to FIG. 3A, the roll bodies are, as a rule, steel rollers with transverse central axes. The spreading apart of the arms 3, 4 of the cartridge pocket 2 is effected by means of the spreader jaws 11, 12 which are in operative contact against the previously-mentioned roll bodies 15, 16.

Concerning the foregoing, the roll bodies 15, 16 are connected with the feed mechanism of the weapon through a point of rotation. The axial movement of the feed mechanism in the direction of arrow 40 causes a radial inward pivoting, in accordance with arrow 41, by the outer lever arms 42. As a result thereof, the roll bodies 15, 16 together with the lever arms 43 are pressed outwardly across the middle points of rotation 44, and the cartridge pocket 2 is spread apart to such an extent that the cartridge 10 can be slid axially out of the cartridge pocket 2.

Figure 4:
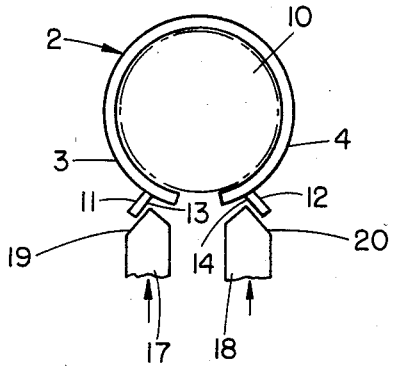
FIG. 4 illustrates a belt portion with inserted cartridge and a second embodiment of the inventive spreader elements.

In lieu of the roll bodies 15, 16, in the embodiment of FIG. 4, as spreader elements there can be introduced bars or sliders 17, 18 between the spreader jaws 11, 12, and which are controlled by the feed mechanism. At the head end of the the bars or sliders 17, 18 these are provided with tapered surfaces 19, 20 which slide along the mutually facing surfaces 13, 14 of the spreader jaws 11, 12 during the upstroke movement.

The roll bodies 15, 16, as well as the bars or the sliders 17, 18 are in connection with the feed mechanism (not shown) so that the spreading apart of the arms of the cartridge pockets will always be carried out at a predetermined timepoint for the cartridge withdrawal. In order to permit the unhindered further transport of the belt, the roll bodies or, respectively, the bars or sliders are taken along by the feed mechanism or moved downwardly out of the way.

Figure 5:
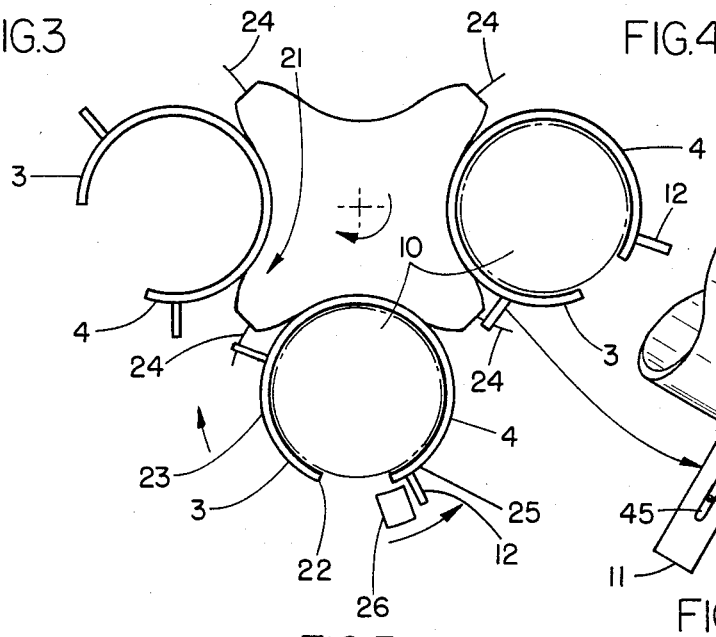
FIG. 5 illustrates a belt portion with inserted cartridge and belt feed mechanism with the inventive spreader elements.

As illustrated in FIG. 5, the cartridge pocket 2 is in engagement with the star wheel 21. Arranged on the arcuately-shaped arm 3 proximate one end 22 is a spreader jaw 23 which stands in engagement with a follower 24 on the star wheel. During rotation of the star wheel 21, the spreader jaw 23 at the end 22, together with the arm 3, is moved generally radially outwardly over a short distance. Since the arm 4 with the spreader jaw 25 strikes against a fixed stop 26, there is effectuated a short spreading apart of the arms 3 and 4 of the cartridge pocket. The caseless cartridge can be withdrawn without any damage. The stop 26 is moved downwardly or in a longitudinal direction in such a manner during the further transport of the belt that the spreader jaw 25 can unhinderedly move further.

Figure 5A:
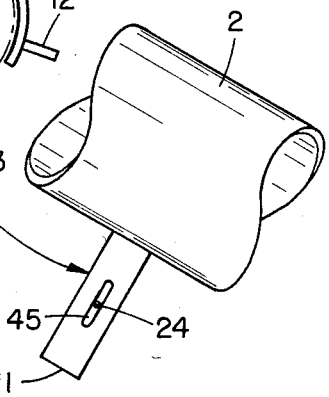
FIG. 5A illustrates a fragmentary side view of the spreader element of FIG. 5.
Figure 5B:
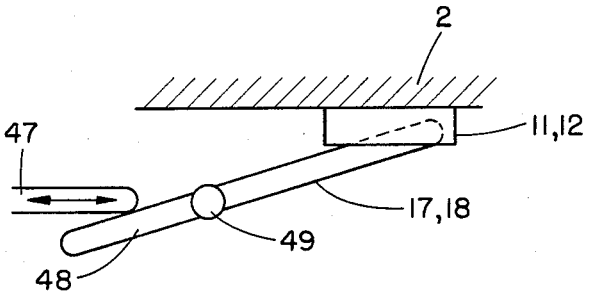
FIG. 5B illustrates, generally diagrammatically, the operative mechanism for the spreader element of FIG. 5.

As shown in FIGS. 5A and 5B, on the arms 3, 4 of the cartridge pocket 2 there are located the spreader jaws 11, 12. The jaw or extension 11 possesses an elongate aperture 45 whereas the jaw or extension 12 can be fully closed. Followers 24 are arranged on the star wheel, which followers each project radially outwardly. These followers 24, during the rotation of a star wheel 21, engage into the longitudinal aperture 45 of the clamping jaw or protuberance 11. In the lower position shown in FIG. 5, the clamping jaw 12 will, upon a further rotation of the star wheel 21, push against a stop 26. The follower 24 travels against the end of the longitudinal aperture of the clamping jaw 11 and thereby spreads the arm 3 of the cartridge pocket 2 apart to such an extent, that the cartridge can be slid out axially from the cartridge belt. Through a pulling back of the stop 26, the arm 4 of the cartridge pocket 2 again snaps together with the arm 3, as a result of which the cartridge pocket is, once again, almost closed in its original form.

Figure 6:
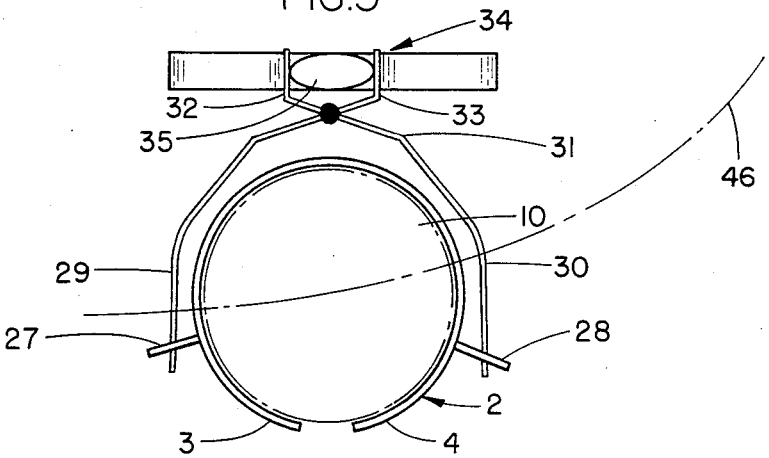
FIG. 6 illustrates a belt portion with inserted cartridge and inventive spreading clamp.

With respect to the structure of FIG. 6, the clamp 31 is entirely a component to the cartridge belt, and is moved together with this cartridge belt; in effect, in conjunction with the cartridge pocket, along the curvilinear path 46. During this curvilinear movement, the upper connectors 32, 33 of the clamp 31 come into engagement with the cam 35. The curvilinear movement of the clamp 31 together with the connectors 32, 33, in the illustrated position in FIG. 6, causes the greatest spreading apart of the clamp 31 and, resultingly, also a spreading apart and widening of the cartridge pocket 2. During the entire movement, the cam 35 remains stationary in the illustrated position.

The function of the sliders 17, 18 which have been designated in the specification either as bars or sliders, both of which refer to the same element, is described hereinbelow, on the basis of FIG. 5B of the drawings.

Similar to the operation of the roll bodies 15, 16, through an axial movement of the feed mechanism 47, the latter is actuated into contact against a lever 48, the latter of which pivots radially inwardly and thereby will move the sliders 17, 18, which are connected at the point of rotation 49, in an outward direction. This outward movement causes a pressing of the arms 3, 4 of the cartridge pocket 2 through contact against the clamping jaws or protuberances 11, 12.

Another type of spreading is illustrated in FIG. 6 of the drawings. In this instance, spreader jaws 27, 28 are again arranged on the arms 3, 4 of the cartridge pocket 2. Engaging into slots on these spreader jaws 27, 28 are the arms 29, 30 of a yoke-shaped clamp 31 having a scissors joint for a striker. A spreading movement is effected in that a tooth 35 of the star wheel 21 engages into the throat-like shaped end portion 34 of the clamp 31 which is formed through parallel extending connectors 32, 33, and due to its larger geometrical dimensions in comparison with the throat width of the claw and because of the scissors action, will cause a spreading apart of the clamp arms 29, 30 and, concurrently, of the arms 3, 4 of the cartridge pocket 2.

In a preferable manner, the cartridge pockets 2, as well as the spreader jaws 11, 12, 23, 25, 27 and 28 and the spreader elements 13, 14, 17, 18, 24, 26, are constructed of metal, for example, steel. The cartridge pockets 2 encase the cartridges 10 along their entire length so as to afford an optimum degree of protection from damage to the cartridges.

Figure 7:
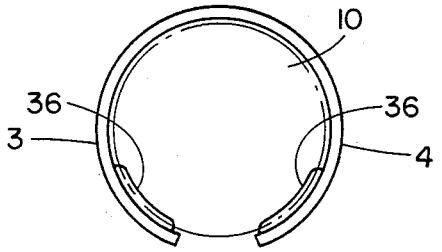
FIG. 7 shows a sectional view through a cartridge pocket taken along line VII—VII in FIG. 2.
Figure 8:
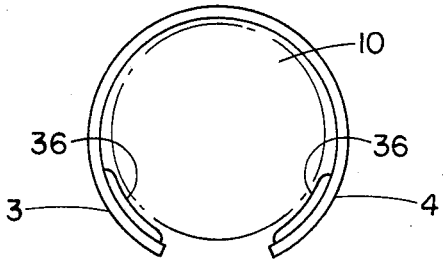
FIG. 8 shows a section through a cartridge pocket similar to that of FIG. 7.

Illustrated clearly in FIGS. 7 and 8 is the positioning of the cartridges 10 within the cartridge pockets 2. When the arms 3, 4 of the cartridge pockets 2 are closed, then the impressed retainers 36 will grip the cartridges and prevent their sliding out in a longitudinal direction. FIG. 8 illustrates the spread apart arms 3, 4 with the generally radially raised retainers 36 whereby there is facilitated the longitudinal displacement of the cartridges.

What is claimed is:

1. In an arrangement for the infeed and withdrawal of caseless ammunition for automatic firearms, including a belt feed mechanism, and a cartridge belt conveyed by said feed mechanism, said cartridge belt having a plurality of interconnected substantially rigid cartridge pockets spaced at regular intervals, each of said pockets being formed of two arms which are bent about the cartridges transversely of the longitudinal axis of said cartridge belt, the improvement comprising said arms being arcuately-shaped metal arms; said arms forming a generally cylindrical structure which extends almost completely around the caseless ammunition to provide protection from damage to the caseless ammunition with a relatively small spacing being provided between the free ends of said arcuately-shaped metal arms, and further having circumferential inwardly extending indentations on said arms for engaging the surface of said caseless ammunition; spreader jaws which extend substantially radially outwardly with respect to the generally cylindrically structure provided near the free ends of each of the metal arms, with the radially outwardly extending spreader jaws being spaced relative to each other near the free ends of said metal arms; and spreader elements on the belt feed mechanism operatively engageable with said radially extending spreader jaws for spreading apart the arcuately-shaped metal arms to disengage said indentations from said caseless ammunition and facilitate withdrawal of the cartridges.

2. Arrangement as claimed in claim 1, said spreader jaws extending in substantially axially parallel relationship, said spreader elements including roll bodies engaging between the facing surfaces of said spreader jaws, the spacing between the spreader jaw being less than the spacing between the outer diameters of the roll bodies.

3. Arrangement as claimed in claim 1 or 2, said spreader elements comprising sliders extending axially parallel relative to each other and being engageable between the spreader jaws, said sliders being actuated by the feed mechanism and having inclined surfaces at ends thereof slideable along the mutually facing surfaces of the spreader jaws for spreading apart said jaws.

4. Arrangement as claimed in claim 1 or 2, said feed mechanism including a star wheel having a follower, a first one of said spreader jaws being spreadable over a short distance relative to the second spreader jaw by said follower during rotational movement of said star wheel; a fixed stop concurrently contactable by the second spreader jaw, said fixed stop being movable out of the running direction of the spreader jaw during the further transport of the belt.

5. Arrangement as claimed in claim 1 or 2, said feed mechanism including a star wheel, said spreader elements comprising a yoke-shaped clamp having a throat-like end portion formed by parallel extending connectors, an end portion of said clamp engaging into said spreader jaws, a tooth on said star wheel having a larger spacing spreadingly extending into said end portion during the rotational movement of the star wheel.

6. Arrangement as claimed in claim 1, said cartridge pockets being formed by said arcuately-shaped metal arms and encasing the cartridges over their entire length.

7. Arrangement as claimed in claim 1, said arcuately-shaped arms, said spreader jaws and said spreader elements engageable therein being constituted of metal.

8. Arrangement as claimed in claim 1, wherein the cartridges are withdrawn from said cartridge pocket by being translated axially forwardly out of said cartridge pocket.

* * * * *